US005578980A

United States Patent [19]

Okubo et al.

[11] Patent Number: 5,578,980

[45] Date of Patent: Nov. 26, 1996

[54] HYBRID SWITCH

[75] Inventors: Koji Okubo; Soichi Okita, both of Kawasaki, Japan

[73] Assignee: Fuji Electric Co., Ltd., Kanagawa, Japan

[21] Appl. No.: 427,952

[22] Filed: Apr. 24, 1995

[30] Foreign Application Priority Data

Apr. 25, 1994 [JP] Japan ..... 6-086125

[51] Int. Cl.[6] ..... H01H 67/02

[52] U.S. Cl. ..... 335/132; 335/202

[58] Field of Search ..... 335/132, 202

[56] References Cited

U.S. PATENT DOCUMENTS 4,466,038 8/1984 Robertson .

4,642,481 2/1987 Bielinski et al. .

*Primary Examiner*—Lincoln Donovan

*Attorney, Agent, or Firm*—Finnegan, Henderson, Farabow, Garrett & Dunner, L.L.P.

[57] ABSTRACT

A hybrid switch comprises an electromagnetic contactor for conducting a current flow after the current making operation, a semiconductor switch device connected in parallel with a main contact of the electromagnetic contactor, for conducting operations of making and breaking a current; and a semiconductor unit body including a case having a square shape in section for housing the semiconductor switch device, and conductor plates which are respectively connected to terminals of the semiconductor switch device and drawn out from sides of the case, end portions of the conductor plates being bent to form main circuit terminals, the semiconductor unit body being mounted on a top portion of the electromagnetic contactor, and the main circuit terminals of the conductor plates drawn out from the semiconductor unit body being fastened to main circuit terminals of the electromagnetic contactor by using terminal screws, respectively.

9 Claims, 7 Drawing Sheets

HYBRID SWITCH

BACKGROUND OF THE INVENTION

1. Field of the Invention

The invention relates to a hybrid switch which is connected between a power source and a load for conducting operations of making and breaking a current flowing through the load.

2. Background of the Invention

In such a hybrid switch, an electromagnetic contactor which is of a contact switch and a semiconductor switch device which is of a contactless switch are connected in parallel to each other, operations of making and breaking a current are conducted by the semiconductor switch, and a current flow after the current making operation is conducted through the electromagnetic contactor. According to the configuration where the semiconductor switch device conducts the current making and breaking operations and a current flows through the electromagnetic contactor, contacts of the electromagnetic contactor are prevented from being worn by arcs which may be generated between the contacts when the current making and breaking operations are conducted only by the electromagnetic contactor, whereby the life of the electromagnetic contactor can be prolonged.

In such a hybrid switch, an electromagnetic contactor and a semiconductor switch which are independently formed are individually mounted on a fixing frame, and they are connected to each other by using external wiring conductors. FIG. 10 is a connection diagram of a conventional hybrid switch of this kind.

In the figure, reference numeral 51 designates a power source for a main circuit, and 52 designates a load. A main circuit contact 53*a* which is driven by a magnetic coil 53 of an electromagnetic contactor is connected between the main circuit power source 51 and the load 52. Reference numeral 53*b* designates an auxiliary contact the operation of which is linked with that of the main contact 53*a* of the electromagnetic contactor. The auxiliary contact 53*b* is a normally closed contact which is closed when the main contact 53*a* is opened, and opened when the main contact 53*a* is closed. Reference numeral 54 designates a bidirectional triode thyristor which functions as a semiconductor switch device (such a thyristor is termed "triac" as a trade name of GE Co., and also in the specification such a thyristor is hereinafter called "triac"). The anode A and the cathode K are respectively connected to the both terminals of the main contact 53*a* in parallel, and the gate G is connected to one terminal of a resistor 55. The other terminal of the resistor 55 is connected to a junction of the anode A and one terminal of the main contact 53*a*. One terminal of the normally closed auxiliary contact 53*b* of the electromagnetic contactor is connected to a junction of the resistor 55 and the gate G of the triac 54, and the other terminal of the auxiliary contact to a junction of the cathode K of the triac 54 and the other terminal of the main contact 53*a*. In the figure, broken lines indicate, external wiring conductors.

The hybrid switch of FIG. 10 operates as follows: FIG. 10 shows a state where an operation voltage (not shown) is not applied to the magnet coil 53 of the electromagnetic contactor. In this state, the gate G and the cathode K of the triac 54 are short-circuited in the order of several milliohms by the normally closed auxiliary contact 53*b*. This allows a current from the resistor 55 to flow through the normally closed auxiliary contact 53*b*. Therefore, noises are prevented from entering the gate G so that the triac is not erroneously ignited. When the operation voltage is applied to the magnet coil 53 of the electromagnetic contactor in this state, the normally closed auxiliary contact 53*b* is opened before the main contact 53*a* is closed, and hence a voltage is applied across the gate G and the cathode K through the resistor 55 so that the triac 54 is immediately rendered conductive. After the triac 54 is turned on, the main contact 53*a* of the electromagnetic contactor is closed. During the period when the main contact 53*a* is closed, therefore, the voltage between the contact terminals of the main contact 53*a* is substantially zero. In other words, arcs are not generated between the contact terminals of the main contact 53*a* during the closed period of the main contact 53*a*. Since the voltage drop of the main contact 53*a* is very smaller than that of the triac 54 in the on-state, the current flow path after the main contact 53*a* is closed is changed from the triac 54 to the main contact 53*a*. Consequently, the triac 54 is requested only to allow a current to flow through it during a short period continuing until the main contact 53*a* is closed.

When the load current is to be interrupted, the application of the operation voltage to the magnet coil 53 is ceased. This causes the main contact 53*a* to be opened so that the load current is interrupted. During the very short period when the state of the main contact 53*a* is transferred from the close state to the open state, the normally closed auxiliary contact 53*b* is opened. Since a voltage is applied across the gate G and the cathode K, the flow path of the load current is changed to the triac 54. When the state of the main contact 53*a* is transferred to the open state, arcs are disposed to be generated between the contact terminals of the main contact 53*a*. Since the flow path of the load current is changed to the triac 54, no arc is generated between the contact terminals of the main contact 53*a*. Then, the normally closed auxiliary contact 53*b* is closed and the gate G and the cathode K of the triac 54 are short-circuited. At the instant when the load current (the current from the AC power source) is reduced to the zero level, the triac is turned off so that the load current is interrupted.

The conventional apparatus shown in FIG. 10 has such a structure that an electromagnetic contactor and a semiconductor switch which are independently formed are individually mounted on a fixing frame, and they are connected to each other by external wiring conductors. This structure suffers from defects such that a large area for installing both the electromagnetic contactor and the semiconductor switch is required, and that a cumbersome wiring work of connecting the electromagnetic contactor and the semiconductor switch by the external wiring conductors must be done. Moreover, the structure has a further drawback that, when the external wiring conductors are erroneously connected during such a wiring work, there occurs a trouble in the switching operation of the semiconductor switch.

SUMMARY OF THE INVENTION

The present invention has been made to eliminate the above-mentioned drawbacks of the conventional apparatus, and an object of the invention to provide a hybrid switch which is capable of reducing the area required for installing the hybrid switch and which requires no wiring work using external wiring conductors.

In order to attain the object, according to one aspect of the invention, there is provided a hybrid switch in which a main contact of an electromagnetic contactor which is of a contact switch and a semiconductor switch device which is of a contactless switch are connected in parallel to each other, operations of making and breaking a current are conducted by the semiconductor switch, and a current flow after the current making operation is conducted through the electromagnetic contactor, the hybrid switch includes a semiconductor unit in which the semiconductor switch device is housed in a case having a square-sectional shape, conductor plates which are respectively connected to terminals of the semiconductor switch device are drawn out from sides of the case, end portions of the conductor plates are bent to form main circuit terminals, the semiconductor unit is mounted on a top portion of the electromagnetic contactor, and the main circuit terminals of the conductor plates drawn out from the semiconductor unit are fastened to main circuit terminals of the electromagnetic contactor by using terminal screws, respectively.

According to a second aspect of the invention, the semiconductor unit includes: a power section having the semiconductor switch device through which a main circuit current flows; a snubber circuit section which protect the semiconductor switch device from an over-voltage; and a control section which detects an operation voltage supplied to a magnet coil of the electromagnetic contactor, and also an opening state of an auxiliary contact the operation of which is linked with the operation of the main contact of the electromagnetic contactor, and which supplies a firing pulse to the semiconductor switch device, the power section, the snubber circuit section, and the control section being held by the case with being piled in a step-like manner.

According to a third aspect of the invention, the conductor plates drawn out from the semiconductor units integrally molded in a process of molding the case so that drawn-out portions of the conductor plates elongating to the main circuit terminals are covered by a casting resin, thereby electrically insulating the conductor plates.

According to a fourth aspect of the invention, the semiconductor unit includes a hook at an end face which is different from end faces from which the conductor plates are drawn out, the hook being engaged with an engaging portion which is previously formed on the electromagnetic contactor, and which functions to attach a cover of the electromagnetic contactor.

According to a fifth aspect of the invention, a lower face of the semiconductor unit is closed by a base plate which is made of a metallic material, the lower face being in the side of the electromagnetic contactor.

According to a sixth aspect of the invention, the semiconductor unit includes a base plate which is molded by a synthetic resin to be integrated with the case, the lower face being in the side of the electromagnetic contactor, and an engaging piece is formed on the base plate, the engaging piece being engaged with an engaging portion which is engaged with an accessory part attached to a top portion of the electromagnetic contactor.

According to a seventh aspect of the invention, the semiconductor unit includes a base plate which is formed to be detachable from the case, and an engaging piece is formed on the base plate, the engaging piece being engaged with an engaging portion which is engaged with an accessory part attached to a top portion of the electromagnetic contactor.

According to an eigth aspect of the invention, the conductor plates are formed to be detachable from the semiconductor unit, the semiconductor unit includes a base plate which is formed to be detachable from the case, and an engaging piece is formed on the base plate, the engaging piece being engaged with an engaging portion which is engaged with an accessory part attached to a top portion of the electromagnetic contactor, the conductor plates being fixed to the base plate.

According to a ninth aspect of the invention, the semiconductor unit includes a pair of conductor plates on each of which an auxiliary contact terminal is formed, the pair of conductor plates being juxtaposed with the conductor plates on which the main circuit terminals are formed, and the auxiliary contact terminals of the pair of conductor plates are connected to auxiliary contact terminals of the electromagnetic contactor by using terminal screws, respectively.

In the hybrid switch according to the first aspect of the invention, the semiconductor unit is mounted on a top portion of the electromagnetic contactor so that the main circuit terminals drawn out from the semiconductor unit are placed over the main circuit terminals of the electromagnetic contactor, and the main circuit terminals of the conductor plates are fastened to the main circuit terminals of the electromagnetic contactor by using terminal screws, respectively, whereby the semiconductor switch device of the semiconductor unit is connected in parallel with the main contact of the electromagnetic contactor.

In the hybrid switch according to the second aspect of the invention, the circuit device portion of the semiconductor unit is divided into three sections according to the functions, the power section, the snubber circuit section, and the control section, and the three sections are piled. Even when the hybrid switch is out of order, therefore, it is required only to replace the defective section with a new one.

In the hybrid switch according to the third aspect of the invention, the electrical insulation of the conductor plates drawn out from the semiconductor unit is conducted at the same time as the process of molding the case.

In the hybrid switch according to the fourth aspect of the invention, the semiconductor unit can be attached to the electromagnetic contactor by using the engaging portion which is previously formed on the electromagnetic contactor.

In the hybrid switch according to the fifth aspect of the invention, the electronic circuit portion of the semiconductor unit is shielded from the electromagnetic contactor by the base plate made of a metallic material. Consequently, noises which may be generated in the electromagnetic contactor are prevented from entering the electronic circuit portion of the semiconductor unit.

In the hybrid switch according to the sixth aspect of the invention, the semiconductor unit can be fixed to the electromagnetic contactor by using the engaging portion which is used for attaching an accessory part and previously formed on the electromagnetic contactor.

In the hybrid switches according to the seventh and eigth aspects of the invention, after the base plate is fixed to the top portion of the electromagnetic contactor, the semiconductor unit can be attached to the base plate. Consequently, the semiconductor unit can easily be attached.

In the hybrid switch according to the ninth aspect of the invention, the output signal of the auxiliary contact of the electromagnetic contactor can be supplied to the semiconductor unit through the conductor plates.

BRIEF DESCRIPTION OF THE DRAWINGS

FIGS. 4A, 4B and 4C are waveform charts illustrating the operation of the hybrid switch shown in the block diagram of FIG. 2, in which FIG. 4A is a waveform chart in the normal case, FIG. 4B is a waveform chart in the case where a contact failure occurs in a normally closed auxiliary contact, and FIG. 4C is a waveform chart in the case where a contact failure occurs in main contacts of an electromagnetic contactor;

DETAILED DESCRIPTION OF THE PREFERRED EMBODIMENTS

Now, a description will be given of embodiments of the present invention with reference to the accompanying drawings.

Figure 1:
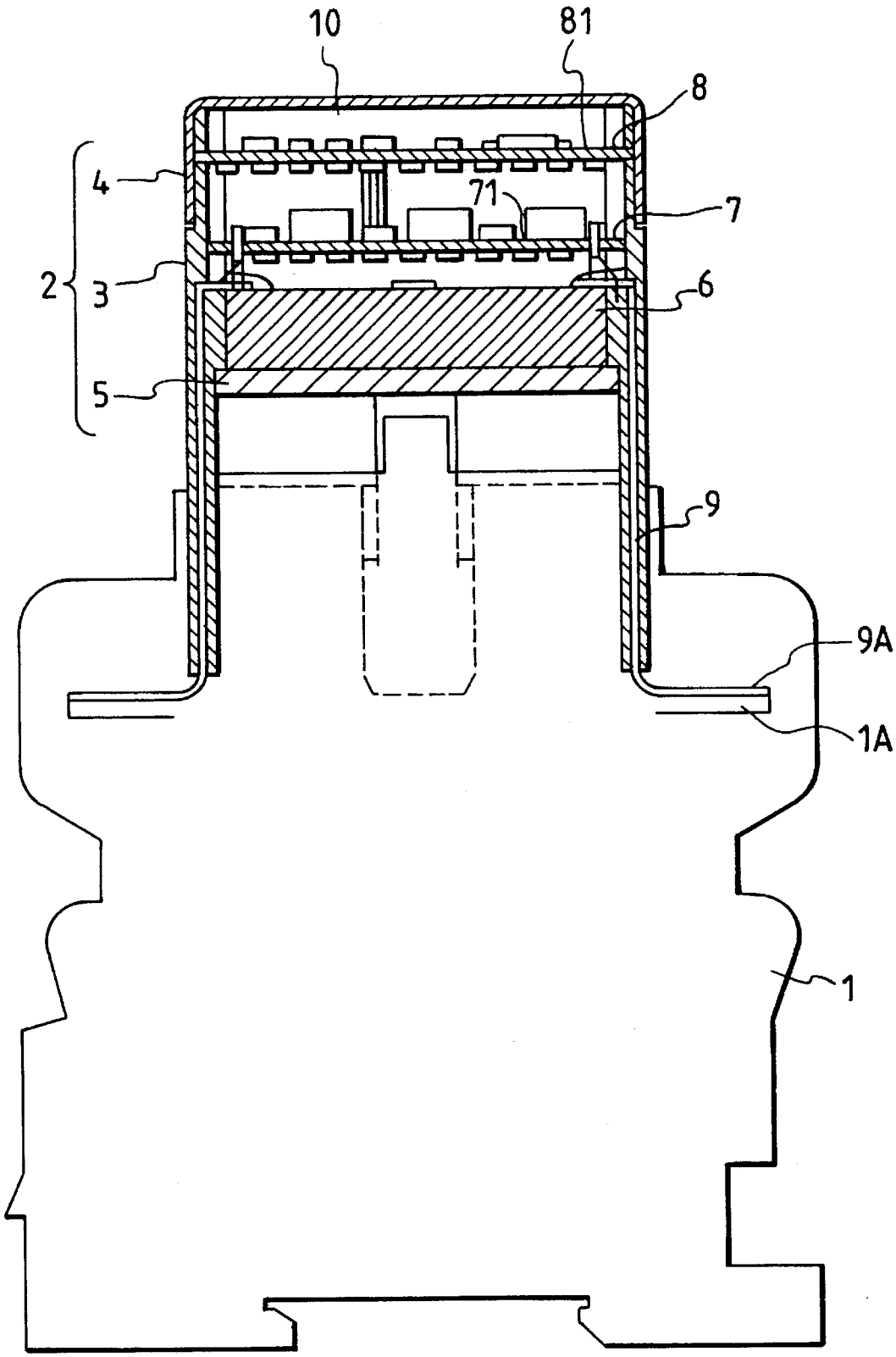
FIG. 1 is a view showing a first embodiment of the hybrid switch of the invention and the sectional structure of a semiconductor unit.
Figure 2:
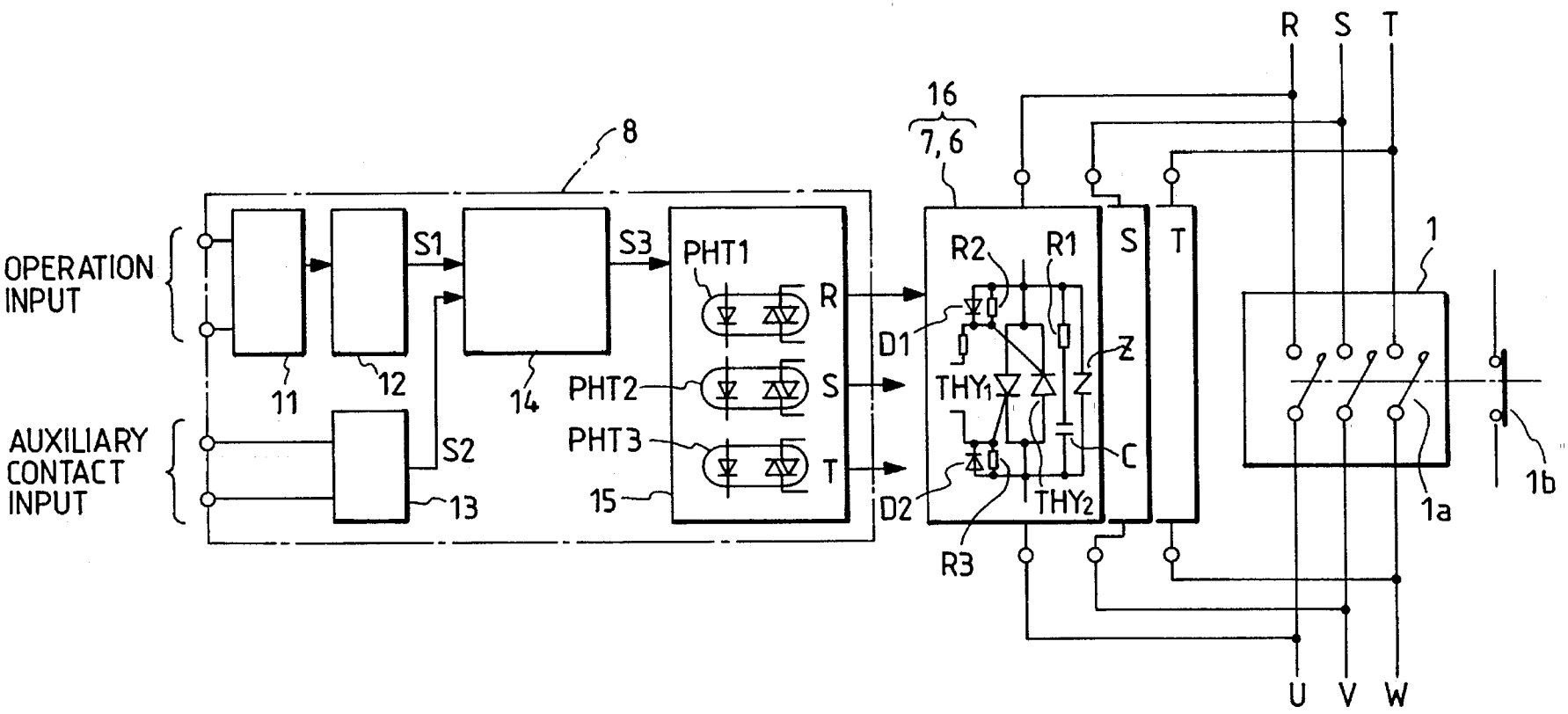
FIG. 2 is a block diagram showing the circuit configuration of the hybrid switch shown in FIG. 1.
Figure 3:
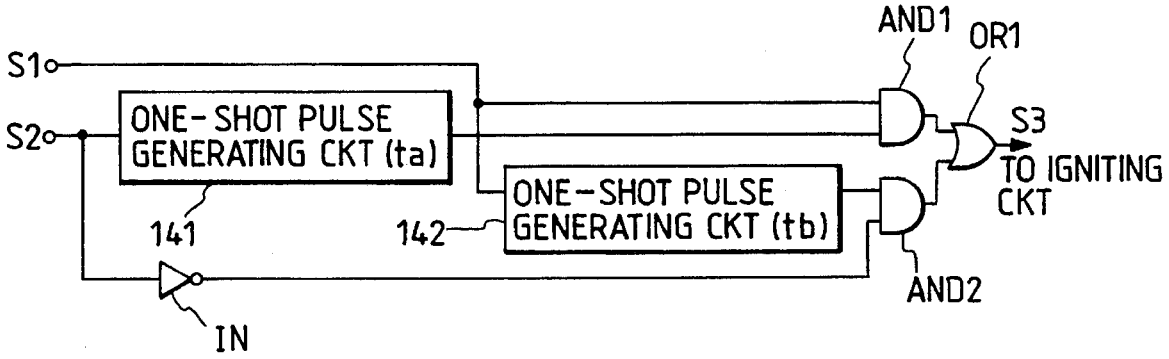
FIG. 3 is a circuit diagram showing the circuit configuration of a one-shot pulse generator shown in the block diagram of FIG. 2.
Figure 10:
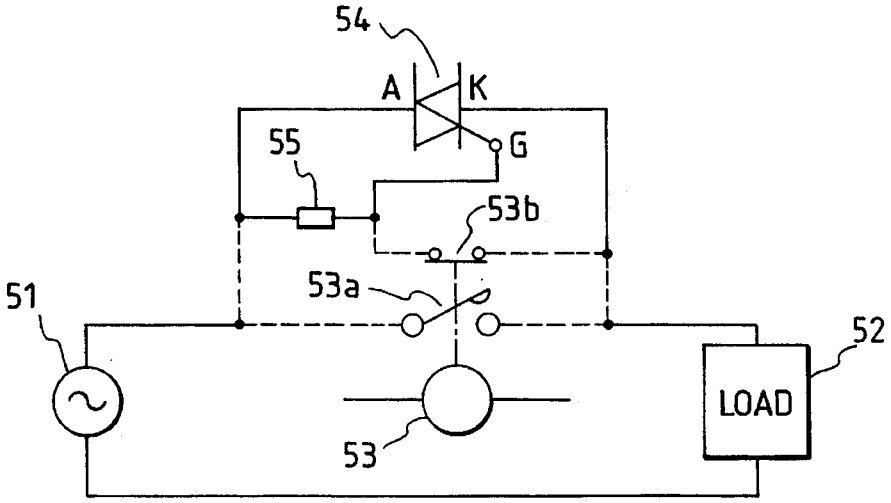
FIG. 10 is a circuit diagram showing an example of the circuit configuration of a prior art hybrid switch.
Figure 4A:
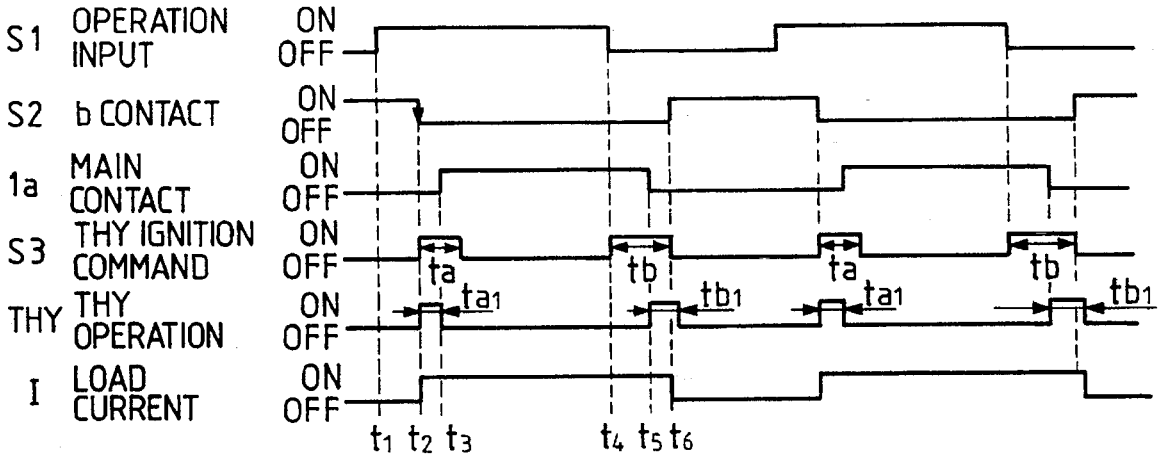
Figure 4B:
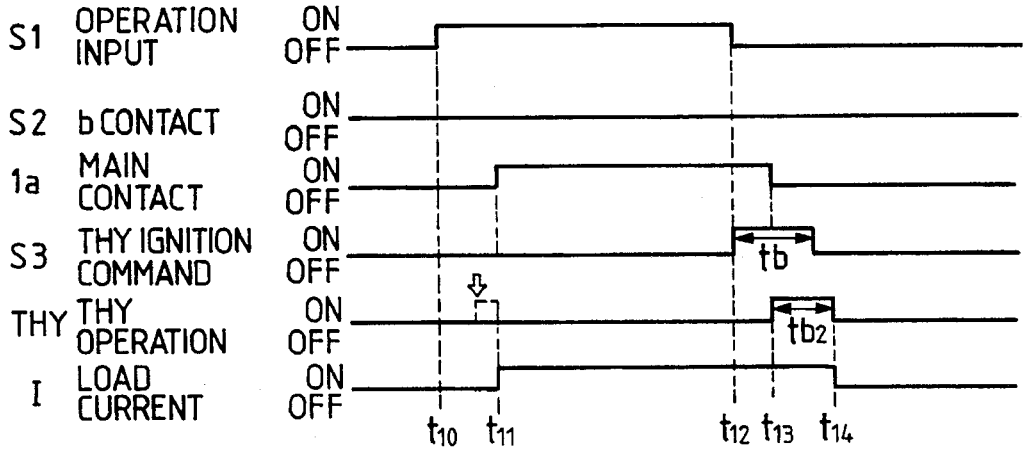
Figure 4C:
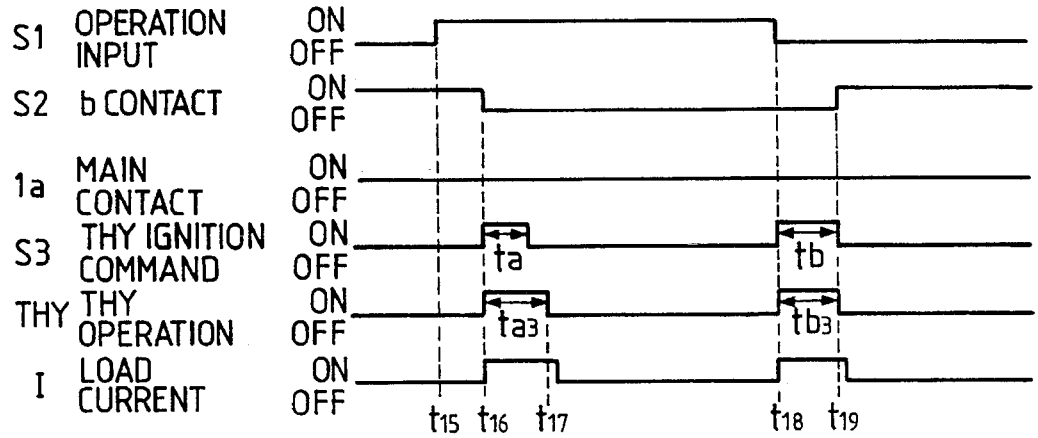
Figure 5:
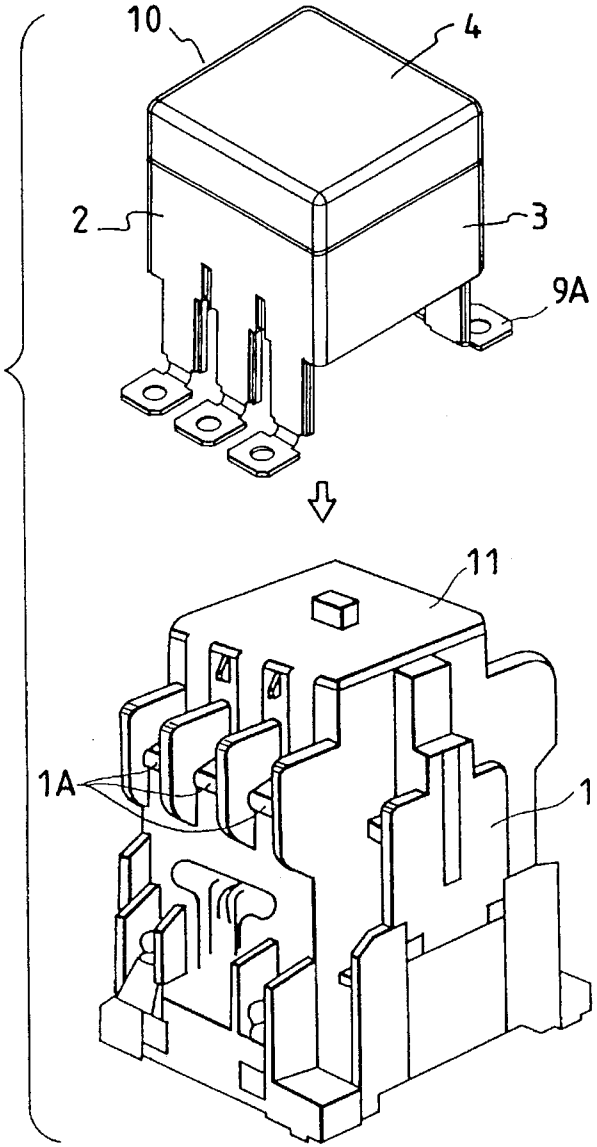
FIG. 5 is a perspective view showing the hybrid switch of FIG. 1 in the state where the semiconductor unit and the electromagnetic contactor are separated from each other.

FIGS. 1 to 5 show an embodiment of the invention. FIG. 1 is a cross-sectional view showing the structure of a main portion of a hybrid switch, FIG. 2 is a block diagram of the hybrid switch, and FIG. 3 is a circuit diagram showing the configuration of a one-shot pulse generator shown in FIG. 2. FIGS. 4A to 4C are waveform charts illustrating the operation of the hybrid switch of FIG. 2, where FIG. 4A is a waveform chart in the normal case, and FIGS. 4B and 4C are waveform charts in the cases where a contact failure occurs in a normally closed auxiliary contact or main contacts of an electromagnetic contactor. FIG. 5 is an exploded view of the hybrid switch of FIG. 1. In FIG. 5, the upper half is a perspective view of a semiconductor unit, and the lower half is a perspective view of the electromagnetic contacto. In FIG. 1, reference numeral 1 designates the electromagnetic contactor which is a contactor well known in the art, and 2 designates a case which houses circuit components of a semiconductor unit 10. The case 2 includes a frame 3 which has a square shape in a cross section, a cover 4 which covers the upper face of the frame 3, and a base plate 5 which closes the lower face of the frame 3 on the side of the electromagnetic contactor 1. In the case 2, the frame 3 and the cover 4 are molded by a casting resin, and the base plate 5 is made of a metal plate. In the inner space of the case 2, a power section 6, a snubber circuit section 7, and a control section 8 into which the circuit components (described later with reference to FIG. 2) constituting the semiconductor unit 10 are classified according to functions are arranged in a step-like manner. The power section 6, the snubber circuit section 7, and the control section 8 are held by the case 2. In the power section 6, a semiconductor switch device which allows the main circuit current to flow therethrough in accordance with a gate pulse is sealed by a resin and held above the base plate 5 with being electrically insulated from the base plate 5. The snubber circuit section 7 is comprised of parts for suppressing an over-voltage applied to the semiconductor switch device constituting the power section 6. The parts are mounted on a printed circuit board 71. The control section 8 includes a circuit which detects an operation voltage supplied to the electromagnetic contactor 1, a circuit which generates a gate pulse to be applied to the semiconductor switch device, and so on. These circuits are mounted on a printed circuit board 81. The snubber circuit section 7 and the control section 8 are fixed to the case 2 by engaging the respective printed circuit boards 71 and 81 with the case 2. Conductor plates 9 are drawn out from the power section 6. End portions of the conductor plates 9 on the side of the power section 6 are connected to the terminals of the semiconductor switch device of the power section 6, respectively. As shown in FIG. 5, the other end portions of the conductor plates 9 are bent outward to form main circuit terminals 9A of the semiconductor unit 10. The conductor plates 9 are formed by pressing strip-like rolled copper bands having rigidity. The drawn-out portions of the conductor plates which elongate to the respective main circuit terminals 9A are embedded into the wall of the frame 3 in the process of molding the frame 3, so as to be integrated with the frame 3. The main circuit terminals 9A of the conductor plates 9 which are bent so as to protrude outward from the frame 3 are placed over respective main circuit terminals 1A of the electromagnetic contactor 1, and fastened together with the main circuit terminals 1A to external wiring conductors (main circuit conductors). In the configuration where the main circuit terminals 9A of the conductor plates 9 and the main circuit terminals 1A of the electromagnetic contactor 1 are fastened together, the rigidity of the conductor plates 9 allows the semiconductor unit 10 to be integrally attached to the electromagnetic contactor 1.

The circuit configuration of the hybrid switch shown in FIG. 1 will be described with reference to FIG. 2. FIG. 2 is a block diagram showing the circuit configuration of the hybrid switch shown in FIG. 1. Since circuits respectively connected between three-phase power source terminals R, S and T and load terminals U, V and W have the same configuration, only the circuit configuration of one phase is shown in FIG. 2.

In the figure, an electromagnetic contactor is again designated by 1. The electromagnetic contactor 1 includes: main contacts 1*a* which are connected at terminals of one side to the three-phase power source terminals R, S and T and at the other terminals to the load terminals U, V and W; and a normally closed auxiliary contact 1*b* the operation of which is linked with the operations of the main contacts 1*a*. A main circuit device block 16 which is a part of the semiconductor unit is connected across both terminals of each of the main contacts 1*a* of the electromagnetic contactor 1. The main circuit device block 16 is provided for each of the R, S and T phases. In other words, three main circuit device blocks 16 are connected. Since the main circuit device blocks 16 have the same configuration, only the block for R phase is shown as a typical one. The main circuit device block 16 includes: thyristors $THY_1$ and $THY_2$ which are connected across both terminals of the main contact 1*a* and in reverse parallel to each other; a capacitor C and a resistor R1 which cooperate to function as a noise filter and are directly connected across both terminals of the thyristors $THY_1$ and $THY_2$; a Zener diode Z functioning as an overvoltage absorber; and diodes D1 and D2 and resistors R2 and R3 which are connected to the gates of the thyristors $THY_1$ and $THY_2$. In the main circuit device block 16, the thyristors $THY_1$ and $THY_2$ constitute the power section 6 shown in FIG. 1, and the other devices constitute the snubber circuit section 7.

Reference numeral 8 designates the control section. The control section 8 includes a rectifying and smoothing circuit 11, a voltage detecting circuit 12, a judging circuit 13, a one-shot pulse generating section 14, and an igniting circuit 15. The rectifying and smoothing circuit 11 receives the operation voltage supplied to a magnet coil (not shown) which operates to close the main contact 1*a* of the electromagnetic contactor 1, and rectifies and smoothes the operation voltage. The voltage detecting circuit 12 outputs a signal (S1) of high level when the voltage supplied from the rectifying and smoothing circuit 11 is higher than a specified value, and the signal (S1) of low level when the voltage supplied from the rectifying and smoothing circuit 11 is lower than the specified value. The judging circuit 13 receives a signal supplied from the normally closed auxiliary contact 1*b*, and outputs a signal (S2) which has a high level or a low level in accordance with the close and open states of the normally closed auxiliary contact 1*b*. The one-shot pulse generating section 14 generates a one-shot pulse signal S3 based on the signals S1 and S2 from the voltage detecting circuit 12 and the judging circuit 13. FIG. 3 shows a circuit diagram of the section. The one-shot pulse generating section 14 shown in FIG. 3 includes a one-shot pulse generating circuit 141, another one-shot pulse generating circuit 142, AND circuits AND1 and AND2, an OR circuit OR1, and an inverter IN. The one-shot pulse generating circuit 141 receives the signal S2 from the judging circuit 13, and outputs a one-shot pulse of a width ta when the signal S2 is changed in level from high to low or the normally closed auxiliary contact 1*b* is changed from the close state to the open state. The one-shot pulse generating circuit 142 receives the signal S1 from the voltage detecting circuit 12, and outputs a one-shot pulse of a width tb when the signal is changed in level from high to low or the operation voltage is changed from the on level to the off level. The AND circuit AND1 obtains a logical product of the one-shot pulse from the one-shot pulse generating circuit 141 and the high-level signal from the voltage detecting circuit 12. When the logical product conditions are satisfied, the AND circuit AND1 outputs a one-shot pulse signal S3 through the OR circuit OR1. The AND circuit AND2 obtains a logical product of the one-shot pulse from the one-shot pulse generating circuit 142 and the high-level signal output when the normally closed auxiliary contact 1*b* is opened (i.e., the high-level signal obtained by inverting the low-level signal indicative of the open state of the normally closed auxiliary contact 1*b* by the inverter IN). When the logical product conditions are satisfied, the AND circuit AND2 outputs the one-shot pulse signal S3 through the OR circuit OR1.

The igniting circuit 15 receives the one-shot pulse signal S3 from the one-shot pulse generating section 14 configured as shown in FIG. 3, and includes a photocoupler PHT1 to which the one-shot pulse signal S3 is supplied. The output of the photocoupler PHT1 is applied to the gates of the thyristors $THY_1$ and $THY_2$ of the main circuit device block 16. Other photocouplers PHT2 and PHT3 of the igniting circuit 15 are used for S and T phase, respectively.

The operations of the hybrid switch shown in the block diagram of FIG. 2 will be described with reference to the waveform charts shown in FIGS. 4A to 4C. In FIGS. 4A to 4C, S1 indicates the output signal of the voltage detecting circuit 12, S2 indicates the on/off output signal of the normally closed auxiliary contact 1*b*, 1*a* indicates the on/off output signal of the main contact 1*a*, S3 indicates the output signal of the one-shot pulse generating section 14, THY indicates an operation signal of the thyristors $THY_1$ and $THY_2$, and I indicates the load current. FIG. 4A is a waveform chart in the normal case, FIG. 4B is a waveform chart in the case where a contact failure occurs in the normally closed auxiliary contact 1*b*, and FIG. 4C is a waveform chart in the cases where a contact failure occurs in the main contact 1*a*. In order to facilitate understanding, the time interval in the waveform charts in the case of a contact failure shown in FIGS. 4B and 4C is prolonged as compared with the waveform chart in the normal case shown in FIG. 4A.

First, at time t1 of FIG. 4A, the operation voltage for the magnet coil of the electromagnetic contactor is applied to the control section 8 and reaches the specified value, and the output signal S1 of the voltage detecting circuit 12 is then changed to the on-state. At the same time, the operation voltage is applied also to the magnet coil of the electromagnetic contactor so that the operation of closing the main contact 1*a* is started. At time t2 before the main contact 1*a* is changed from the open state to the close state, the normally closed auxiliary contact 1*b* is changed from the close state to the open state. When the normally closed auxiliary contact 1*b* is opened, the one-shot pulse generating circuit 141 (see FIG. 3) outputs the one-shot pulse signal of a width ta. Since the signal from the voltage detecting circuit 12 has already been changed to a high level at this time, the one-shot pulse signal S3 of a width ta is output through the AND circuit AND1 and the OR circuit OR1. The signal S3 causes an ignition signal (gate signal) to be applied to the thyristors $THY_1$ and $THY_2$ of the main circuit device block 16 through the igniting circuit 15, whereby the thyristors $THY_1$ and $THY_2$ are turned on at time t2 to supply the load current I to the load. After time t3 when the main contact 1*a* of the electromagnetic contactor 1 is closed, the load current I flows through the main contact 1*a* in place of the thyristors $THY_1$ and $THY_2$, thereby preventing arcs from being generated between the contact terminals of the main contact 1*a*. As seen from the above, the thyristors $THY_1$ and $THY_2$ allow the load current to flow through them during only the short period ta1 between times t2 to t3, and are turned off at the instant when the AC current of the three-phase power source crosses the zero level.

When the operation voltage is interrupted after the electromagnetic contactor 1 is closed or at time t4, the level of the signal S1 is changed from high to low. Therefore, the one-shot pulse generating circuit 142 outputs the one-shot pulse signal of a width tb. Since the normally closed auxiliary contact 1*b* is in the open state at time t4, the high-level signal is supplied to one input of the AND circuit AND2 so that the one-shot pulse from the one-shot pulse generating circuit 142 is output as the one-shot pulse signal S3 through the AND circuit AND2 and the OR circuit OR1. The one-shot pulse signal S3 causes the ignition signal to be applied to the thyristors $THY_1$ and $THY_2$ through the igniting circuit 15, so that the thyristors $THY_1$ and $THY_2$ enter the turn-on enabled state. Since the main contact 1*a* is in the close state at time t4, the thyristors are not turned on. When the main contact 1*a* is opened at time t5, the load current I begins to flow through the thyristors $THY_1$ and $THY_2$. When the main contact 1*a* is opened, therefore, arcs are not generated between the contact terminals of the main contact. When the normally closed auxiliary contact 1*b* is closed at time t6 after the main contact 1*a* is opened, the logical product conditions of the AND circuit AND2 shown in FIG. 3 are not satisfied, and hence the one-shot pulse signal S3 is extinguished at time t6 so that also the ignition signal for the thyristors $THY_1$ and $THY_2$ is extinguished. Thereafter, the thyristors $THY_1$ and $THY_2$ are turned off at the instant when the AC current of the three-phase power source crosses the zero level, with the result that the thyristors $THY_1$ and $THY_2$ are turned on during only the short period tb1 between times t5 to t6.

Next, the operations in the case where a contact failure occurs in the normally closed auxiliary contact 1*b* will be described with reference to the waveform chart of FIG. 4B.

In this case, when the operation voltage is applied at time t10 and exceeds the specified value, the output signal S1 is changed to be high. At the same time, the operation of closing the main contact 1*a* is started. Since there occurs a contact failure in the normally closed auxiliary contact 1*b*, however, the signal S2 remains to be low. Therefore, the one-shot pulse generating circuit 141 does not output the one-shot pulse signal, and hence the thyristors $THY_1$ and $THY_2$ are kept to be turned off. In the electromagnetic contactor 1, after the operation voltage is applied at time t10, the main contact 1*a* is closed at time t11 so that the load current I flows through the contactor. When the operation voltage is interrupted at time t12, the signal S1 is made low and the one-shot pulse generating circuit 142 outputs the one-shot pulse signal of a width tb. At this time, since the normally closed auxiliary contact 1*b* is in the open state, the igniting circuit 15 outputs the one-shot pulse signal S3 as the ignition signal to the thyristors $THY_1$ and $THY_2$ through the AND circuit AND2 and the OR circuit OR1. This causes the thyristors $THY_1$ and $THY_2$ to enter the turn-on enabled state, but are not turned on because the main contact 1*a* is closed. When the main contact 1*a* is opened at time t13, the thyristors $THY_1$ and $THY_2$ are turned on so that the load current I begins to flow through the thyristors $THY_1$ and $THY_2$. At time t14 when the AC current of the three-phase power source crosses the zero level after the one-shot pulse signal S3 is extinguished, the thyristors $THY_1$ and $THY_2$ are turned off. As seen from the above, in the case where a contact failure occurs in the normally closed auxiliary contact 1*b*, the thyristors $THY_1$ and $THY_2$ are not turned on when the electromagnetic contactor is closed. When the electromagnetic contactor is to be opened, the thyristors $THY_1$ and $THY_2$ are turned on during only a short period tb2. Consequently, the thyristors $THY_1$ and $THY_2$ are prevented from being thermally destroyed.

Next, the operations in the case where a contact failure occurs in the main contact 1*a* will be described with reference to the waveform chart of FIG. 4C.

In this case, the operations that the operation voltage is applied at time t10, that the signal S1 is made high when the voltage exceeds the specified value, that the normally closed auxiliary contact 1*b* is closed at time t16 and the one-shot pulse generating circuit 141 outputs the one-shot pulse, and that the one-shot pulse signal S3 of a width ta causes the thyristors $THY_1$ and $THY_2$ to be turned on are conducted in the same manner as the case shown in FIG. 4A. Since there is a contact failure in the main contact 1*a*, however, the main contact 1*a* is kept to be in the open state. Therefore, the thyristors $THY_1$ and $THY_2$ are turned on during only a short period ta3 which continues from the instant when the one-shot pulse signal S3 of a width ta is extinguished and until the AC current of the three-phase power source crosses the zero level. When the operation voltage is interrupted at time t18, the one-shot pulse generating circuit 142 outputs the one-shot pulse signal. The one-shot pulse signal causes the one-shot pulse signal S3 to be applied to the thyristors $THY_1$ and $THY_2$. Since the main contact 1*a* is in the open state at this time, the thyristors $THY_1$ and $THY_2$ are turned on at the same time when the one-shot pulse signal S3 is applied. The opening operation of the electromagnetic contactor makes the normally closed auxiliary contact 1*b* opened so that the one-shot pulse signal S3 is extinguished. Thereafter, the thyristors $THY_1$ and $THY_2$ are turned off at time t19 when the AC current of the three-phase power source crosses the zero level, and turned on during only a short period tb3. As seen from the above, in the case where there is a contact failure in the main contact 1*a*, the thyristors $THY_1$ and $THY_2$ are turned on during the short period to pass the load current therethrough at each of the operations of closing and opening the electromagnetic contactor 1. Since the period during which the load current flows through the thyristors $THY_1$ and $THY_2$ is short, however, the thyristors are prevented from being thermally destroyed.

According to the above-described hybrid switch of the invention, when the thyristors have a capacity as small as sufficient for being turned on to allow the load current to flow therethrough during only a short period at each of the operations of closing and opening the electromagnetic contactor, the thyristors are prevented from being thermally destroyed even in the case where a contact failure occurs in the main contact or the normally closed auxiliary contact of the electromagnetic contactor.

FIG. 5 is an exploded perspective view showing the hybrid switch which is shown in FIG. 1 and consists of the electromagnetic contactor 1 and the semiconductor unit 10, in the state where the semiconductor unit 10 is detached from the electromagnetic contactor 1. The detachable semiconductor unit 10 is integrally attached to the electromagnetic contactor 1 by fastening the main circuit terminals 9A of the conductor plates 9 (see FIG. 9) of the unit to the main circuit terminals 1A of the electromagnetic contactor 1 by using terminal screws which are not shown. The configuration in which the semiconductor unit 10 is integrated with the top portion of the electromagnetic contactor 1 can reduce the floor area occupied by the hybrid switch to that of the electromagnetic contactor 1. The conductor plates 9 having the main circuit terminals 1A correspond to wires connecting the both terminals of the main circuit device blocks 16 shown in FIG. 2 to the three-phase power source terminals R, S and T and the load terminals U, V and W. The reference numeral 11 designates a cover which covers a switching chamber of the electromagnetic contactor 1.

Figure 6:
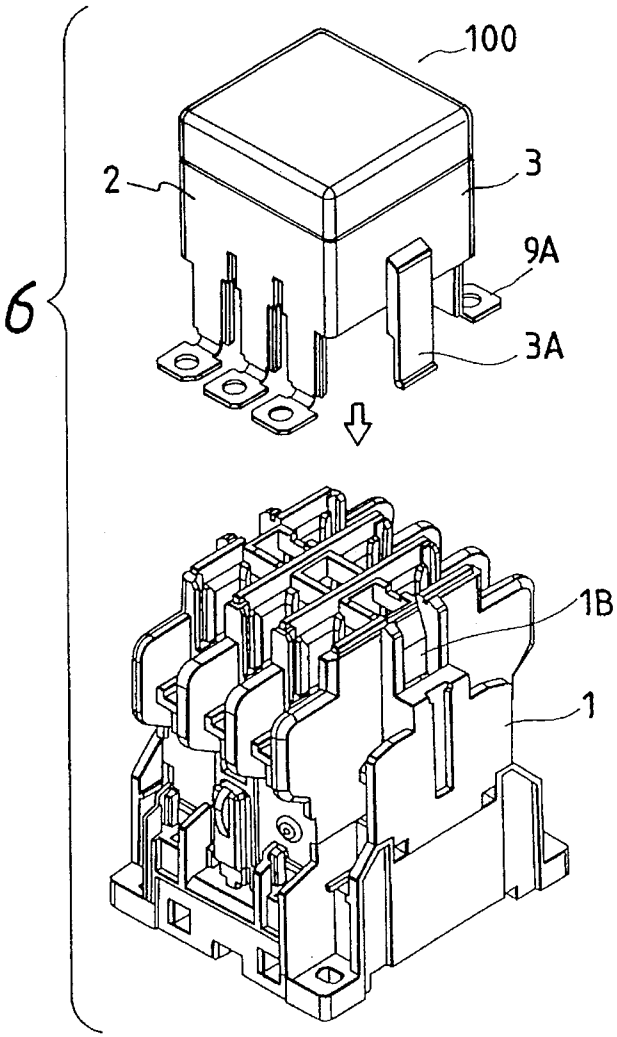
FIG. 6 is a perspective view showing a second embodiment of the hybrid switch of the invention in the state where the semiconductor unit and the electromagnetic contactor are separated from each other.

FIG. 6 is an exploded perspective view showing a second embodiment of the invention. The embodiment is modified so that the semiconductor unit 10 in the embodiment of FIGS. 1 to 5 is fixed more firmly to the electromagnetic contactor 1. The electromagnetic contactor 1 shown in FIG. 6 is of the type in which the fixing of the cover 11 (see FIG. 5) to the electromagnetic contactor 1 is realized by a hook that is engaged with an engaging portion 1B of the electromagnetic contactor 1. In FIG. 6, the cover 11 is removed away. A hook 3A is formed at a position of a semiconductor unit 100 which corresponds to the engaging portion 1B of the electromagnetic contactor 1. When the semiconductor unit 100 is to be fixed to the electromagnetic contactor 1, the hook 3A of the semiconductor unit 100 is engaged with the engaging portion 1B of the electromagnetic contactor 1. In the embodiment, the main circuit terminals 9A of the semiconductor unit 100 are fixed together with the main circuit terminals of the electromagnetic contactor 1 by using terminal screws. According to the embodiment, in summary, the engaging portion 1B which is used for fixing the cover of the electromagnetic contactor 1 is used also for fixing the semiconductor unit 100.

Figure 7:
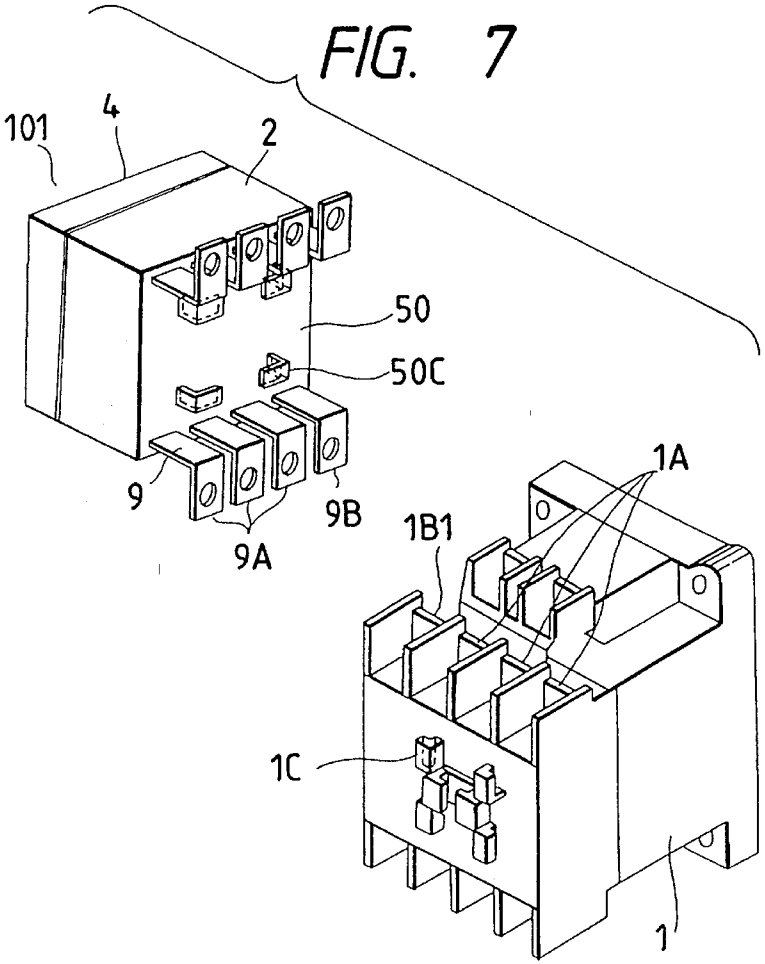
FIG. 7 is a perspective view showing a third embodiment of the hybrid switch of the invention in the state where the semiconductor unit and the electromagnetic contactor are separated from each other.

FIG. 7 is an exploded perspective view showing a third embodiment of the invention. The electromagnetic contactor 1 of the embodiment is of the type in which an accessory part is mounted on the top portion of the electromagnetic contactor 1 and auxiliary contact terminals 1B1 are formed so as to be juxtaposed with the main circuit terminals 1A for three phases. In order to mount the accessory part for the electromagnetic contactor, four engaging portions 1C which in cross section define an L-shape and are engaged with the accessory part when the accessory part is to be mounted on the contactor are formed on the top portion of the electromagnetic contactor 1. In a semiconductor unit 101 which is to be attached to the electromagnetic contactor 1, the lower face 50 of the case 2 is integrally formed by a casting resin, and L-shaped engaging pieces 50C which are to be engaged with the engaging portions 1C of the electromagnetic contactor 1 are formed on the lower face 50. Two sets of four conductor plates 9 are drawn out from the lower face 50 of the case 2. In each of the sets, three conductor plates 9 constitute the main circuit terminals 9A, and the remaining conductor plate juxtaposed with the main circuit terminals 9A is an auxiliary contact terminal 9B. In contrast to the embodiments shown in FIGS. 1, 5 and 6 wherein lead wires are used for transmitting the signal from the normally closed auxiliary contact 1*b* of the electromagnetic contactor 1 to the semiconductor unit 10 or 100, the auxiliary contact terminals 9B are used for receiving directly from the auxiliary contact terminals 1B1 of the electromagnetic contactor 1. In the embodiment, the electromagnetic contactor 1 is attached to the semiconductor unit 101 in the following manner: The semiconductor unit 101 is placed on the top portion of the electromagnetic contactor 1 in such a manner that the engaging pieces 50C formed on the lower face 50 are positioned in the side of but separated from the engaging portions 1C of the electromagnetic contactor 1. Thereafter, the semiconductor unit 101 is slid laterally so that the engaging pieces 50C are engaged with the engaging portions 1C, respectively, whereby the engaging pieces 50C of the semiconductor unit 101 are pressingly inserted into the engaging portions 1C of the electromagnetic contactor 1 to be engaged therewith. In this state, the main circuit terminals 9A and the auxiliary contact terminals 9B are placed over the main circuit terminals 1A and the auxiliary contact terminals 1B1, respectively. Then the main circuit terminals 9A and the auxiliary contact terminals 9B are fastened together with the main circuit terminals 1A and the auxiliary contact terminals 1B1 by using terminal screws. In the embodiment, the conductor plates 9 protruding the case 2 are not covered by the casting resin of the case 2. Alternatively, the conductor plates 9 may be covered by the casting resin of the case 2.

Figure 8:
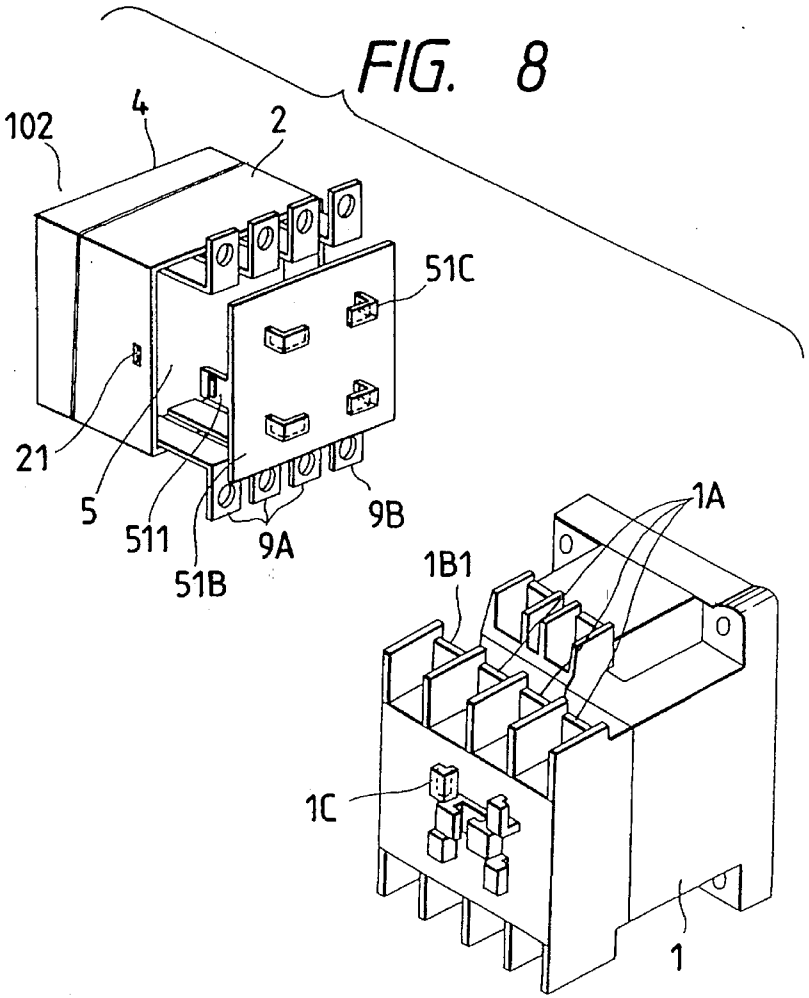
FIG. 8 is a perspective view showing a fourth embodiment of the hybrid switch of the invention in the state where the semiconductor unit and the electromagnetic contactor are separated from each other.

FIG. 8 shows a modification of the embodiment shown in FIG. 7. Briefly speaking, the modification shown in FIG. 8 is different from the embodiment shown in FIG. 7 in that the lower face 50 shown in FIG. 7 is detachably attached to the case 2. In a semiconductor unit 102, therefore, the case 2 such as that shown in FIG. 1 opens in the lower face, and a separate base plate 51B having a size which allows the base plate to be inserted between the conductor plates drawn out through the opening is provided. The base plate 51B is inserted into the opening of the case 2. In the base 51B, hooks 511 are respectively formed on the side faces different from the side faces from which the conductor plates 9 are drawn out. Holes 21 which engage with the hooks 511 are opened in the case 2. Engaging pieces 51C are formed on the base plate 51B in the same manner as the engaging pieces 50C shown in FIG. 7. In the modification shown in FIG. 8, the electromagnetic contactor 1 is attached to the semiconductor unit 102 in the following manner: First, the base plate 51B separated from the semiconductor unit 102 is mounted on the electromagnetic contactor 1. Then the engaging pieces 51C of the base plate 51B are engaged with the engaging portions 1C of the electromagnetic contactor 1 in the same manner as that described in conjunction with FIG. 7. The semiconductor unit 102 is placed on the base plate 51B integrated with the electromagnetic contactor 1 so that the base plate 51B is inserted into the opening of the case. The hooks 511 of the base plate 51B are engaged with the holes 21 of the case 2, respectively, whereby the semiconductor unit. 102 is integrated with the electromagnetic contactor 1. In the modification, since only the base plate 51B is first attached to the electromagnetic contactor 1, the operation of integrating the semiconductor unit 102 with the electromagnetic contactor 1 can easily be conducted.

Figure 9:
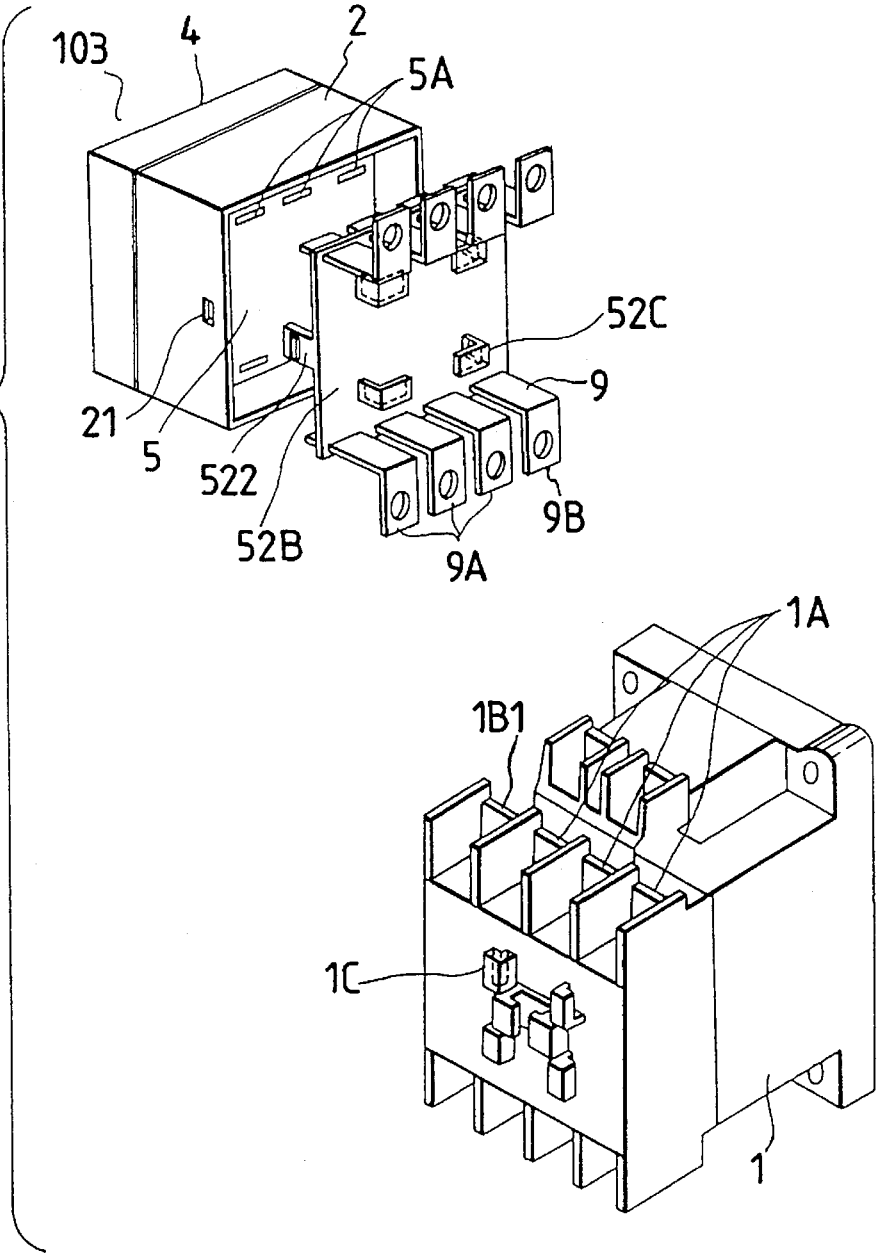
FIG. 9 is a perspective view showing a fifth embodiment of the hybrid switch of the invention in the state where the semiconductor unit and the electromagnetic contactor are separated from each other.

FIG. 9 shows a modification of the embodiment shown in FIG. 8. The modification shown in FIG. 9 is different from the embodiment shown in FIG. 8 in that the conductor plates 9 of a semiconductor unit 103 are fixed to a separate base plate 52B and the conductor plates 9 are pressingly fitted into holes 5A formed in the base plate 5 of the case 2. It is a matter of course that terminal portions which clamp the conductor plates 9 to be electrically connected therewith are formed in the case 2, and that the base plate 5 and the conductor plates 9 are electrically insulated from each other. On the base plate 52B, formed are hooks 522 which are to be engaged with the holes 21 of the case 2, and engaging portions 52C which are to be engaged with the engaging portions 1C of the electromagnetic contactor 1.

In the modification shown in FIG. 9, the electromagnetic contactor 1 is attached to the semiconductor unit 103 in the following manner: First, the base plate 52B separated from the semiconductor unit 103 is mounted on the electromagnetic contactor 1. Then the engaging pieces 52C of the base plate 52B are engaged with the engaging portions 1C of the electromagnetic contactor 1 in the same manner as that described in conjunction with FIG. 7. The semiconductor unit 103 is placed so that the holes 5A formed in the base plate 5 of the case 2 coincide with the conductor plates 9 of the base plate 52B integrated with the electromagnetic contactor 1, and the semiconductor unit 103 is then fitted onto the base plate 52B so that the hooks 522 of the base plate 52B are engaged with the holes 21 of the case 2, whereby the semiconductor unit 103 is integrated with the electromagnetic contactor 1.

According to the invention, the semiconductor unit is mounted on the top portion of the electromagnetic contactor, and the main circuit terminals of the conductor plates drawn out from the semiconductor unit are fastened to the main circuit terminals of the electromagnetic contactor by using terminal screws, respectively, whereby the semiconductor switch device can be connected in parallel with the main contact of the electromagnetic contactor. This eliminates a work of connecting the main contact of the electromagnetic contactor with the semiconductor switch device through external wiring conductors. The elimination of the connection work using external wiring conductors can prevent an erroneous connection from occurring. Since the semiconductor unit is mounted on the top portion of the electromagnetic contactor, the hybrid switch can be configured in a small size. Furthermore, the floor area occupied by the hybrid switch can be restricted to that of the electromagnetic contactor, so that the area required for installing the hybrid switch is reduced. This enables a switch panel to be structured in a reduced size.

What is claimed is:

1. A hybrid switch for making and breaking a current, comprising:

an electromagnetic contactor having a top portion and side portions, said electromagnetic contactor having main contact terminals for conducting a flow of the current after a current making operation;

a semiconductor switch device connected in parallel with the main contact terminals of said electromagnetic contactor, for conducting operations of making and breaking the current; and a semiconductor unit body mounted on the top portion of the electromagnetic contactor, said body including a casing having a substantially square top portion and four side portions housing said semiconductor switch, a plurality of contact plates having a first portion extending downwardly from opposite side portions in a direction substantially perpendicular to said top portion, said plurality of plates embracing the side portions of the electromagnetic contactor, each of said plurality of plates having an end portion with a hole, said end portions being bent outwardly from said opposite side portions of the unit body to form circuit terminals aligned with and substantially parallel to said main circuit terminals of the electromagnetic contactor; and a terminal screw mounted in each of said holes and corresponding main circuit terminals, fastening the semiconductor body to said main circuit terminals.

2. A hybrid switch according to claim 1, wherein said semiconductor unit body further comprises: a power section having said semiconductor switch device through which a main circuit current flows; a snubber circuit section for protecting said semiconductor switch device from an overvoltage; and a control section for detecting an operation voltage supplied to a magnet coil of said electromagnetic contactor, and an opening state of an auxiliary contact the operation of which is linked with the operation of said main contact of said electromagnetic contactor, and for supplying a firing pulse to said semiconductor switch device, said power section, said snubber circuit section, and said control section being piled in a step-like manner within said casing.

3. A hybrid switch according to claim 1, wherein said contact plates drawn out from said semiconductor unit are integrally molded by molding said case so that end portions of said contact plates are elongated to said main circuit terminals and are covered by a casting resin, to electrically insulate said contact plates.

4. A hybrid switch according to claim 1, wherein said semiconductor unit further comprises a hook located at one of the side portions of said body which does not include the contact plates, said hook being engaged with an engaging portion formed on said electromagnetic contactor, and which attaches a cover of said electromagnetic contactor.

5. A hybrid switch according to claim 1, wherein said semiconductor unit further comprises a base plate made of a metallic material for closing a lower face of said semiconductor unit, said lower face being on the side of said electromagnetic contactor.

6. A hybrid switch according to claim 1, wherein said semiconductor unit further comprises a base plate which is molded by a synthetic resin to be integrated with said case, said base plate being on the side of said electromagnetic contactor, and an engaging piece formed on said base plate, said engaging piece being engaged with an engaging portion of said electromagnetic contactor, with an accessory part attached to a top portion of said electromagnetic contactor.

7. A hybrid switch according to claim 1, wherein said semiconductor unit further comprises a base plate which is formed detachably from said case, and an engaging piece formed on said base plate, said engaging piece being engaged with an engaging portion of said electromagnetic contactor, with an accessory part attached to a top portion of said electromagnetic contactor.

8. A hybrid switch according to claim 1, wherein said contact plates are detachable from said semiconductor unit, and said semiconductor unit body further comprises a base plate detachable from said case, and an engaging piece on said base plate, said engaging piece being engaged with an engaging portion of said electromagnetic contactor, with an accessory part attached to a top portion of said electromagnetic contactor, said contact plates being fixed to said base plate.

9. A hybrid switch according to claim 1, wherein said plurality of contact plates includes a pair of contact plates, each of said pair of contact plates including an auxiliary contact terminal, said pair of contact plates being juxtaposed with said contact plates on which said main circuit terminals are formed, and said auxiliary contact terminals of said pair of contact plates being connected to auxiliary contact terminals of said electromagnetic contactor by terminals screws.

* * * * *